US005838225A

United States Patent [19]

Todd

[11] Patent Number: 5,838,225

[45] Date of Patent: Nov. 17, 1998

[54] ANTI-THEFT ALARM FOR ELECTRICALLY OPERATED DEVICES

[75] Inventor: John Todd, Toronto, Canada

[73] Assignee: Micro Switch Corporation, Waterloo, Canada

[21] Appl. No.: 694,525

[22] Filed: Aug. 9, 1996

[51] Int. Cl.[6] ..... G08B 13/14

[52] U.S. Cl. ..... 340/571; 340/568; 70/57.1

[58] Field of Search ..... 340/693, 652, 340/568, 571, 541, 545, 542; 70/57.1, 58, 6

[56] References Cited

U.S. PATENT DOCUMENTS

| | | | |
|---|---|---|---|
| 3,815,117 | 6/1974 | Gopperton | 340/571 |
| 3,836,901 | 9/1974 | Matto et al. | 340/571 X |
| 4,237,450 | 12/1980 | Canez | 340/571 |
| 4,284,983 | 8/1981 | Lent | 340/571 X |
| 4,316,181 | 2/1982 | Primont et al. | 340/571 |
| 4,327,360 | 4/1982 | Brown | 340/571 |
| 4,385,288 | 5/1983 | Bitko | 340/571 |
| 5,317,304 | 5/1994 | Choi | 340/571 |
| 5,434,559 | 7/1995 | Smiley et al. | 340/571 |

*Primary Examiner*—Jeffery A. Hofsass
*Assistant Examiner*—Anh La

[57] ABSTRACT

An anti-theft alarm is provided, for an externally powered electrically operated device which has an openable case containing internal components. The alarm comprises:

a) a rechargeable battery b) a motion sensor to detect movement of the device, and a tamper switch to determine if the case is about to be opened or has been opened, c) a DC power supply connected to a circuit for recharging the battery, the DC supply being dependent on the external power supply for the device, d) a warning means activated by controller, powered by the battery, the controller being activated by a condition selected from the group consisting of i) no DC power and activation of the motion sensor and ii) activation of the tamper switch e) an arming latch which keeps the warning means activated when either of the conditions in d) is satisfied f) a key switch which is adapted to disarm the alarm when the DC power is off.

The alarm is particularly useful for computers which are valuable in themselves or have valuable components.

8 Claims, 7 Drawing Sheets

ANTI-THEFT ALARM FOR ELECTRICALLY OPERATED DEVICES

FIELD OF THE INVENTION

The present invention relates to an anti-theft device for devices powered by external electrical power sources. It is particularly useful for the protection of computers, televisions, VCR's and the like which are easily portable.

BACKGROUND TO THE INVENTION

In the past few years computers have become commonplace in commerce, in industry and in the home. As the amount of storage and computing capacity goes up, the more valuable are the computers, their component parts, the software stored on them and the information contained on disk, tape or optical storage devices. While original equipment manufacturers and software manufacturers have concentrated on developing password systems and other security devices to prevent unauthorized access to information on the computer, very little has been done to physically protect the computers themselves. This is surprising, given the fact that computers are getting smaller and therefore more easily stolen, or the fact that computers are becoming more modularized, with important component parts which are very easily and quickly removed from computers. Even physical protection has been limited, e.g. to cable restraints which are attached to the outer case of a computer and an immobile object such as a desk. Although large numbers of thefts of computers and components are reported to police and company security personnel, there is little chance of recovery. It is costly to replace stolen computers. Perhaps more importantly though, considerable loss of time and resources occurs as a result of having to reconstitute lost information. This is particularly so for small businesses and home businesses, which rely heavily on computerized information and transactions. Also, all information stored in memory, e.g. on hard disk is also stolen, thus compromising security of information. Preventing theft of computers and their component parts such as disk drives, memory chips, CPUs, expansion cards and the like is very important for businesses, and increasingly for home computer users. In high traffic area such as hospitals, and in poorly guarded areas (most small businesses) computers are easily targetted and stolen.

Attempts have been made in the past to provide anti-theft devices for televisions, computers and the like. For example, U.S. Pat. No. 4,908,608 which issued Mar. 13, 1990 discloses electrical equipment with a security device which is controlled by a microprocessor. The microprocessor produces a warning from a warning device when the electrical power is lost and/or the equipment is moved. The device has an interface which requires a password and which also allows battery checks, alarm tests and alarm arming sequences to be passed between the equipment and the security device. The security device is mounted inside the computer, with the circuitry on a card installed in a so-called expansion slot in the computer. U.S. Pat. No. 5,317,304 which issued May 31, 1994 to A. Choi shows a battery-operated device which is used to trigger an alarm. The battery may be recharged. There may be an anti-tamper switch which senses when the device's housing is being removed. The alarm must be programmed for delay before triggering, and for loudness and duration. It has a disarming key. The device may be external to a computer or internal, mounted in an expansion slot. The device requires a key pad which is used to set various control parameters, such as alarm loudness, and provides a password protection and alarm disarming function. U.S. Pat. No. 4,686,514 which issued Aug. 11, 1987 discloses an electrically operated alarm which has a motion sensing switch, and an anti-tamper switch to detect opening of a computer case. None of the alarms are entirely satisfactory. The present invention is intended to provide an improved alarm for electrically operated devices.

SUMMARY OF THE INVENTION

Accordingly the present invention provides an anti-theft alarm for an externally powered electrically operated device, said device having a case containing internal components, said alarm comprising:

a) a rechargeable battery;

b) input sensing means comprising a motion sensor to detect movement of the device, and a tamper switch to determine if the case is about to be opened or has been opened;

c) a DC power supply connected to a circuit for recharging the battery, said DC supply being dependent on the external power supply for the device;

d) a warning means activated by controller means, powered by the battery, said controller means being activated by a condition selected from the group consisting of i) no DC power and activation of the motion sensor and ii) activation of the tamper switch;

e) an arming latch which keeps the warning means activated when either of the conditions in d) is satisfied;

f) a key switch which in a first position is able to disarm the alarm when the DC power is off and in a second position is able to arm the alarm.

The alarm may be an analogue device or a digital device.

In another embodiment at least the tamper switch and key switch are is contained in a housing which has a base and a cover selected from the group consisting of a) said base being attachable to the case for the electrically operated device, said key switch being attached to the cover and said key switch and base having means such that, when the key switch is locked, the cover cannot be removed from the base and, when the key switch is unlocked, the cover is detachable from the base and b) said base being attachable to the case for the electrically operated device, said key switch being attached to the base and said key switch and cover having means such that, when the key switch is locked, the cover cannot be removed from the base and, when the key switch is unlocked, the cover is detachable from the base.

In a further embodiment the tamper switch comprises a cooperating post and hinge lever switch.

DETAILED DESCRIPTION OF PREFERRED EMBODIMENTS

Figure 1:
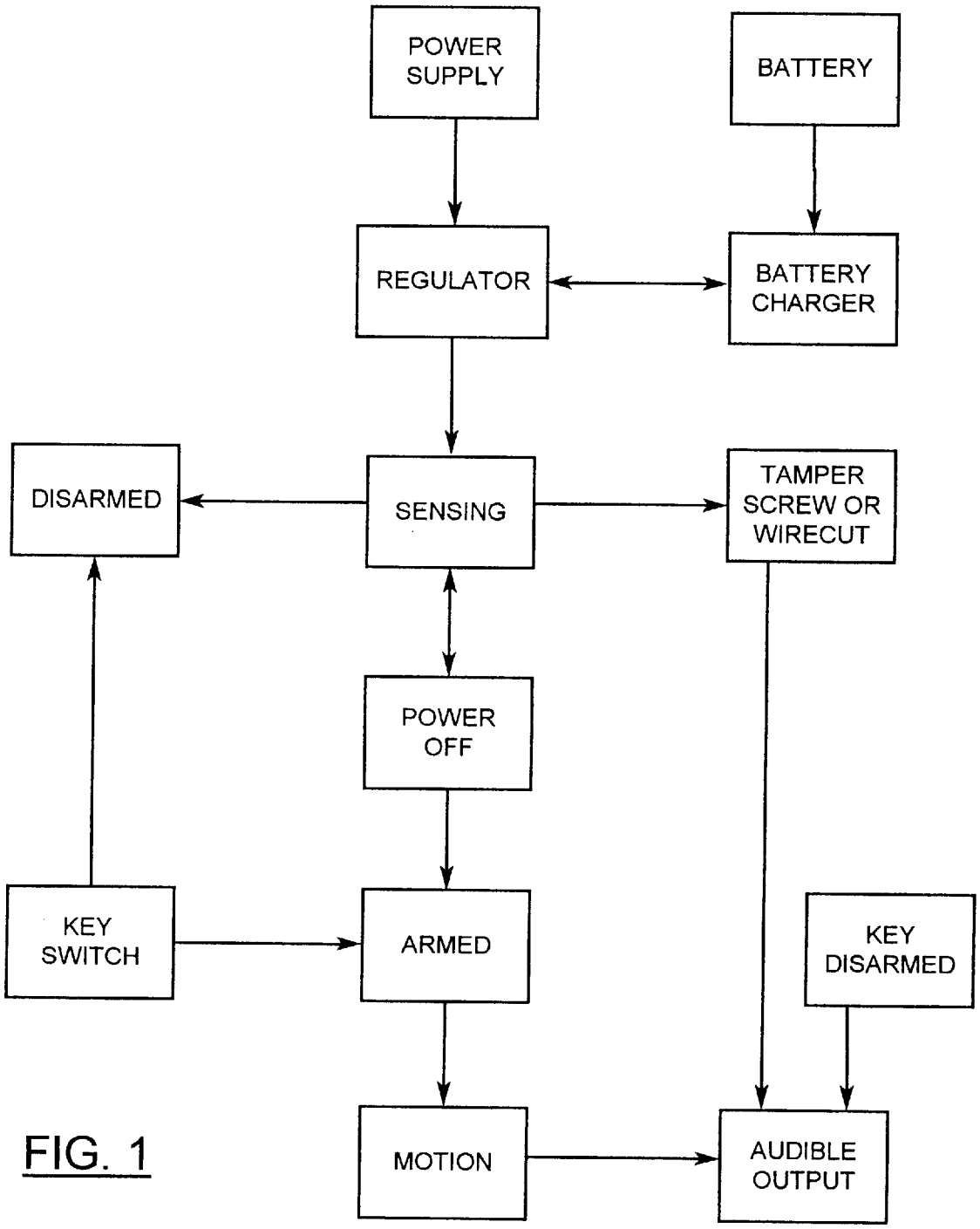
FIG. 1 is a block diagram showing the various functions in one embodiment of the anti-theft alarm.

FIG. 1 is a block diagram which shows the DC power supply feeding through a regulator to a battery charger and to the rest of the alarm circuitry through the sensing device. The sensing device may be a mercury switch or other motion detecting device. The preferred motion detector is a piezo-electric sensor or tip switch. If the power is off then the alarm is armed. If the motion sensor then detects motion, an audible alarm is set off.

In the event that the tamper device, e.g tamper screw, membrane switch, hinge lever switch, is activated, then the audible alarm is set off, whether the power is connected or not. The audible alarm or the motion sensor can be disarmed by means of a key switch.

Figure 2:
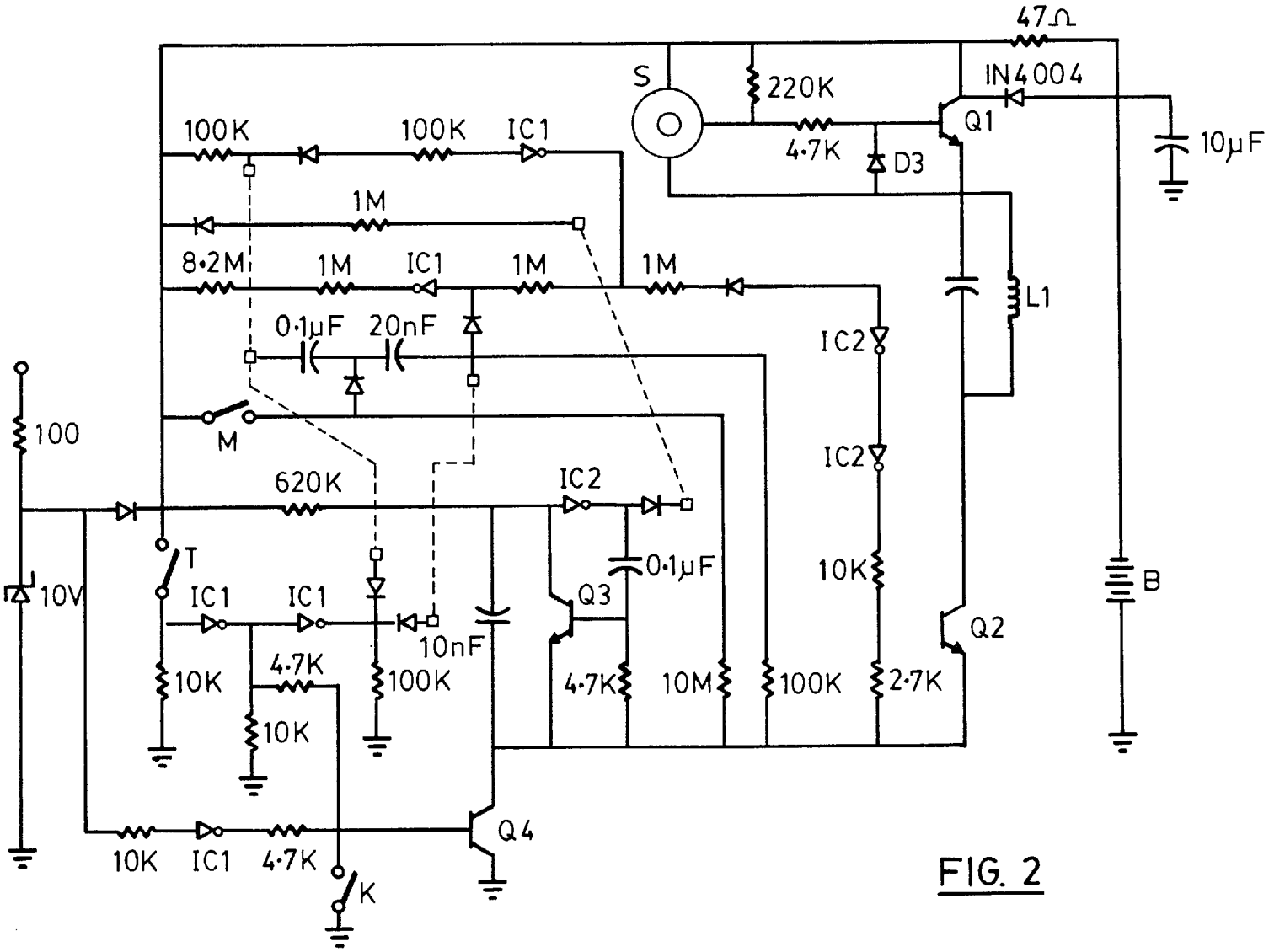
FIG. 2 shows an electrical circuit diagram of another embodiment of the anti-theft alarm.
Figure 3:
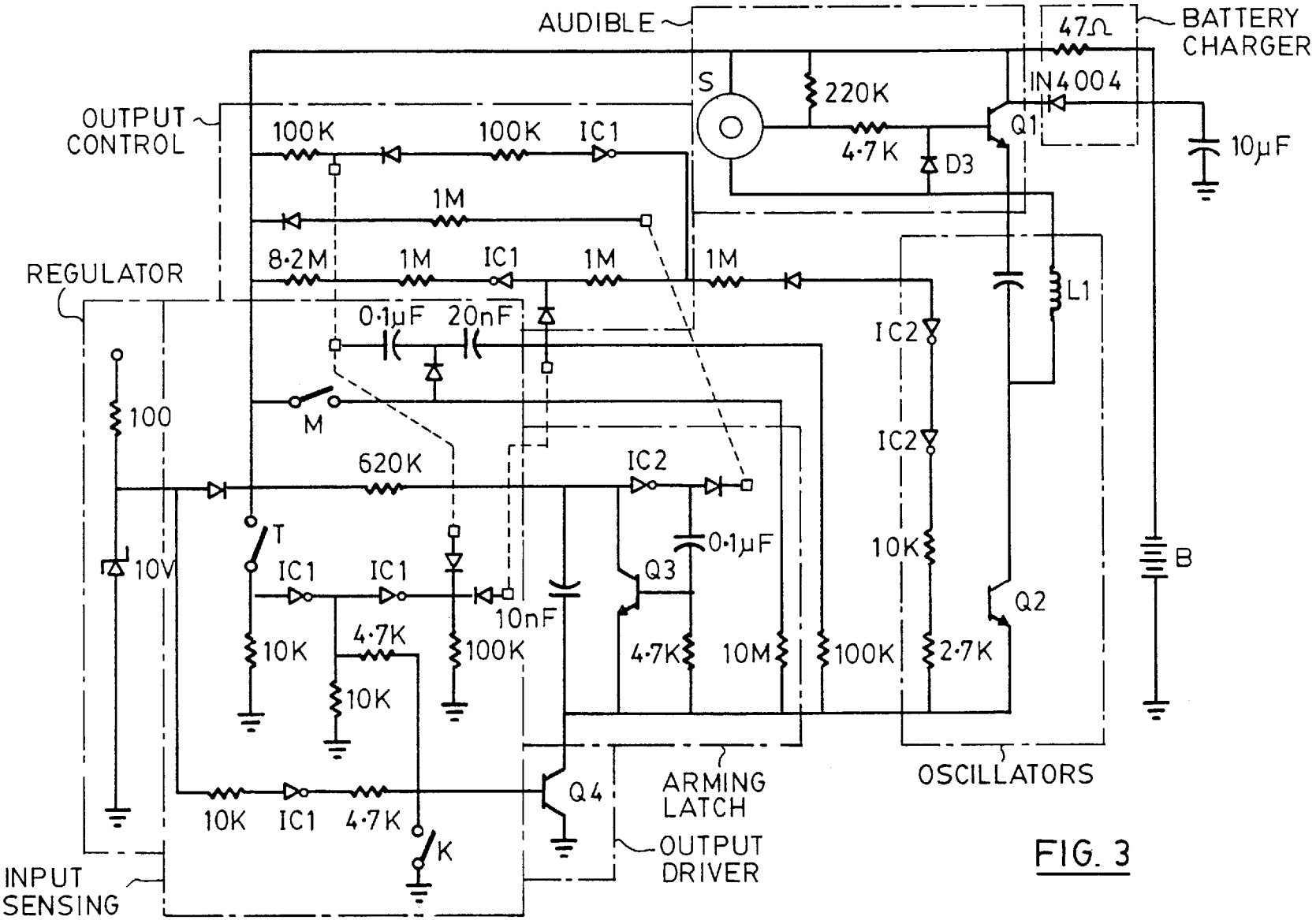
FIG. 3 is the same as FIG. 2 except that it overlays the functions of portions of the circuitry.

FIGS. 2 and 3 show an alarm which has a speaker S associated therewith. Computers, televisions, VCRs and the like are generally operated using mains AC current and may have stepped down voltages and power supply available. Computers most often have a rectifier/transformer for the provision of 12 vDC, for operation of the components within. This DC source may be used with the present invention. The function of the DC source inasfar as the alarm is concerned is two-fold. The first is to provide a means for recharging battery B. The second is to provide a means, of telling whether the AC power is connected to the computer. If the AC power is cut off, either by unplugging the AC power cord, cutting the power cord or shutting off the AC power, then there is no DC power.

When there is DC power available it is possible to activate motion sensor M without the arming latch and thus the alarm being activated. When there is no external power to the present alarm, the battery is the sole electrical source. In this condition, if the motion sensor M is tipped and thus activated, the arming latch ensures that power is continuously sent to the speaker or buzzer S. If the AC power is turned back on, then the alarm returns to its quiescent state.

Preferably the alarm has circuitry or switching which permits modifying the volume of the alarm and the time it takes between activation of the motion sensor and activation of the speaker or buzzer. For example in a hospital environment it may be desirable to give an early warning of activation of the alarm, in the event that the alarm is accidentally triggered. This may be accomplished by giving a 30, 60 or 120 second delay before the alarm is set off. In addition, or alternatively, the alarm may be set off at low volume to begin with, but after a short time, e.g. 30 or 60 seconds the alarm is set off at full volume. Such conditions may be pre-set in the factory, may be settable on site by means of switches or other means. Suitable means for controlling the time delays include capacitors and programmable interrupter circuits (PICs).

If the tamper switch T is activated, then the arming latch ensures that power is continuously sent to the speaker or buzzer S, whether the DC power is on or off. This prevents a thief from opening the case and removing valuable components from therein without having to take the whole computer. The tamper switch may be an on-off switch which is controlled by the distance that a case-holding screw is screwed into the case, e.g when the screw is fully screwed in, the circuit is open and when the screw is removed or not fully screwed in the circuit is closed. Other types of tamper switch include membrane switches and hinge lever subminiature switches.

Figure 4A:
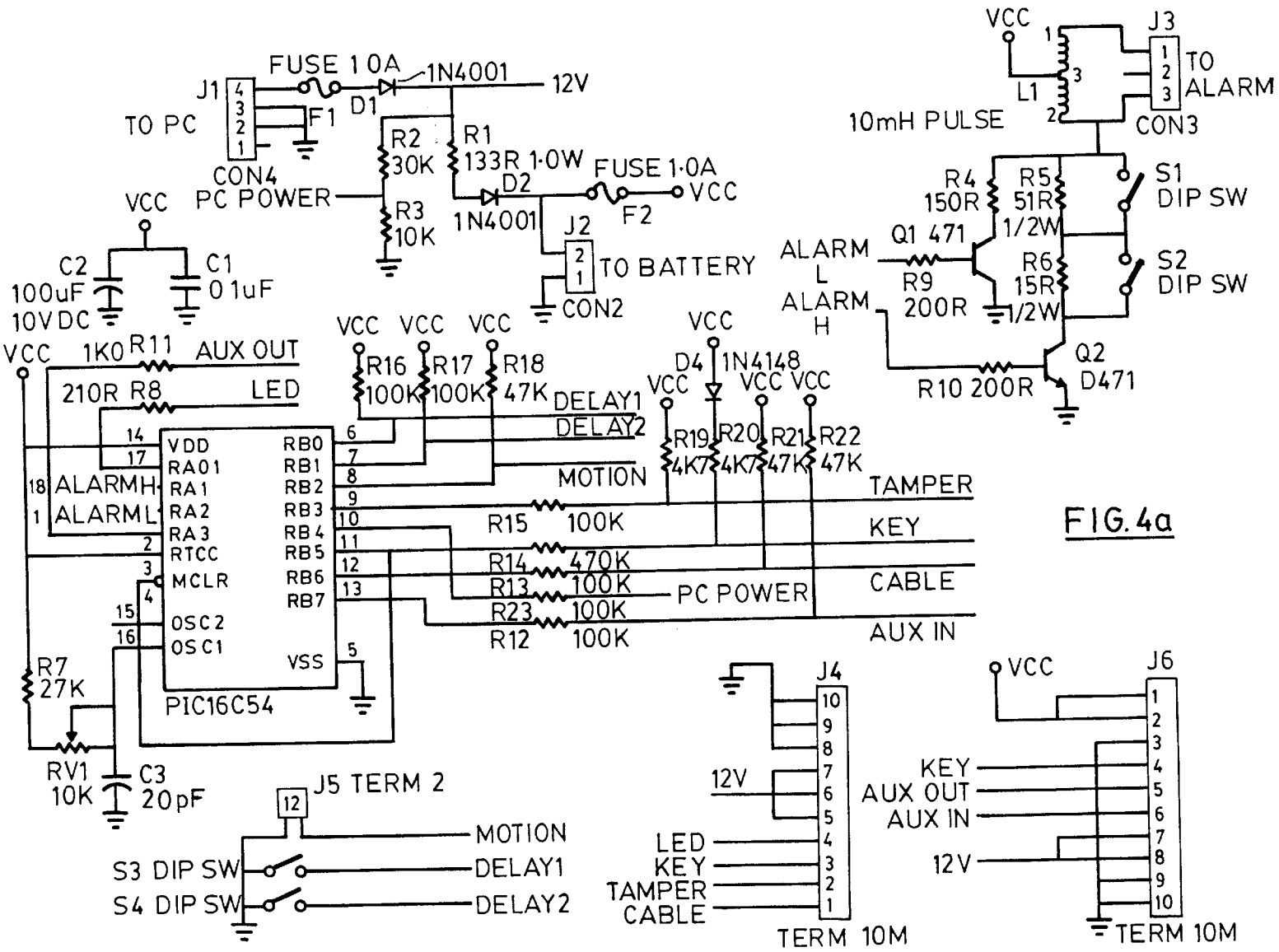
FIGS. 4*a* and 4*b*, when combined, comprise a circuit diagram for an embodiment of an anti-theft alarm operated with a computerized chip.
Figure 4B:
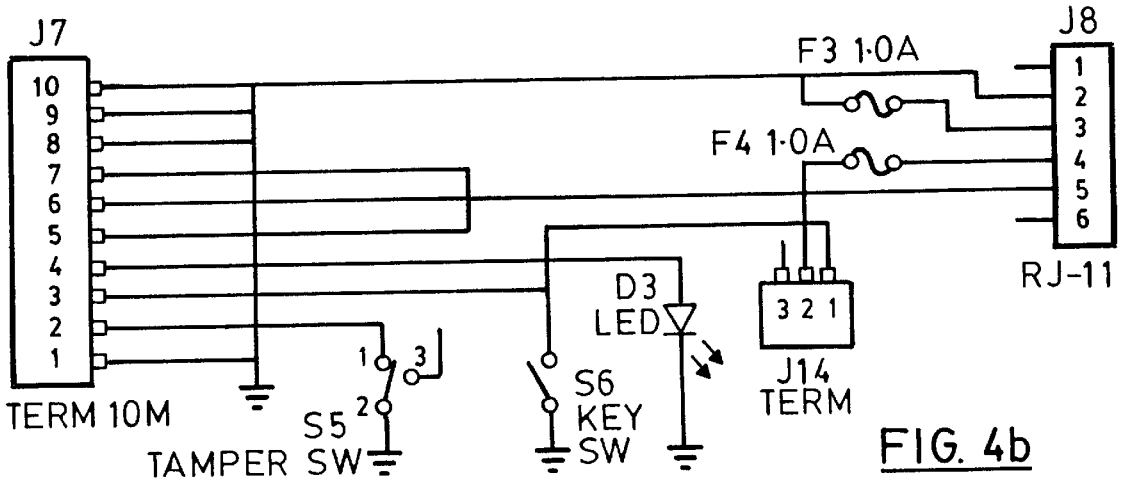

FIGS. 4*a* and 4*b* show another, preferred circuit diagram for a digitally-operated anti-theft alarm, which acts similarly to that shown in FIGS. 2 and 3.

Of course, legitimate movement of the computer is desirable, as is legitimate removal of the case, for example for reasons of maintenance and upgrading. A key lock is provided to electrically disarm the alarm.

In one embodiment the key lock may perform both an electrical or electronic function to disarm the alarm and also a mechanical function with respect to the tamper switch. With respect to the tamper switch, the key lock preferably is located in a box, comprising a base and a cover, which is attached to the outside of the computer case.

The box covers may cover the tamper device, e.g. motion detector. Preferably, however, the tamper device is located inside the electrically operated device, e.g. a computer, primarily because there is usually plenty of room to house the tamper device. In addition in the case of a motion detector, the spacial alignment is important and the detector cannot be mounted on its side.

Figure 5:
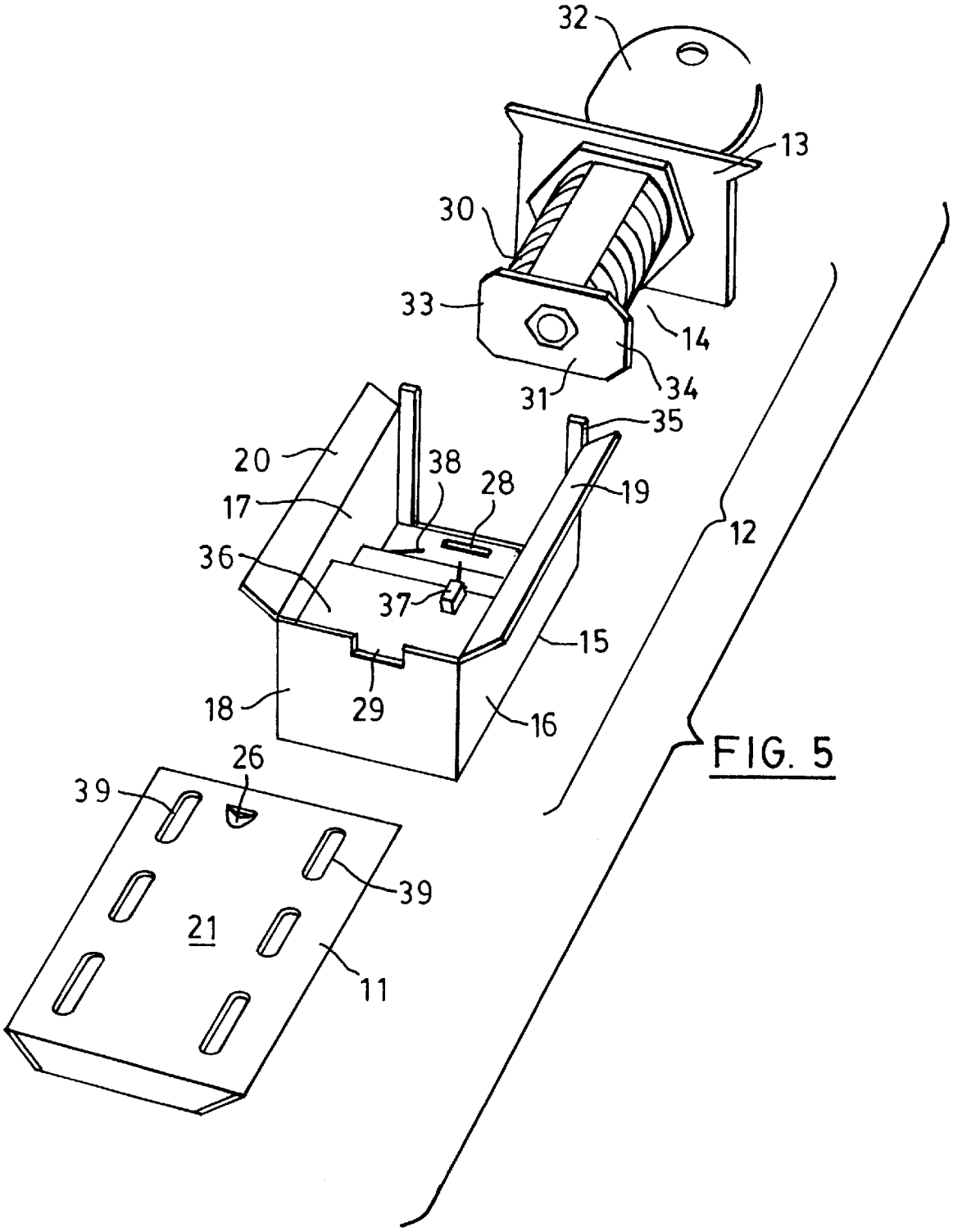
FIG. 5 is an exploded view of a lock and associated cover with some electronic components therein, and a base of an embodiment of an anti-theft alarm.
Figure 5A:
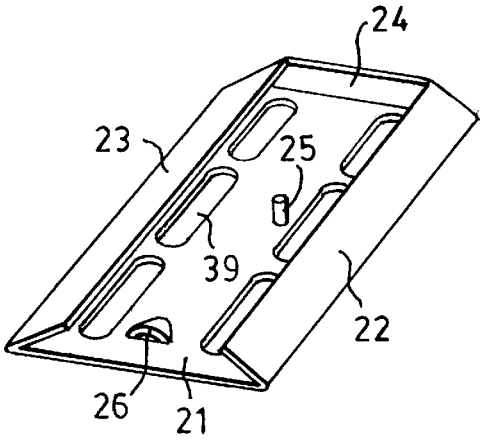
FIGS. 5*a* and 5*b* show an inside of the base and a plate for a lock, respectively, used in FIG. 5.
Figure 5B:
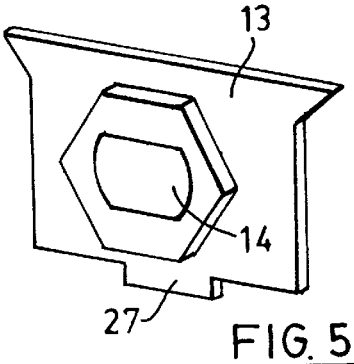

The preferred box is shown in FIG. 5. The base for the box is better explained by reference to FIG. 5*a*. The box comprises a base 11 and a cover 12. In the embodiment shown the cover is in two pieces, i.e. plate 13 in which key lock 14 is mounted, and shroud 15. Shroud 15 has two side walls 16 and 17, an end wall 18, and end posts 35 at the end of cover opposite to end wall 18. The bottoms of walls 16 and 17 have flared skirts 19 and 20 respectively. Base 11 has a bottom 21 and inwardly flared walls 22 and 23, and end wall 24 attached thereto. Base also has a post 25, a raised stop 26 and a plurality of screw apertures 39. Plate 13 has a tongue 27 which is adapted to fit into slot 28 in shroud 15. End wall 18 has a cut-out 29 for passage of a cable. Key lock 14 has a body 30 and a plate 31 which is rotatable by means of a key 32. Plate 31 has tongues 33 and 34 on opposite sides of the axis of rotation of the plate 31.

Located inside the box, e.g. in shroud 15, are some electronic and mechanical components of the alarm. Components that are preferably not housed in the box include a DC power supply, a rechargeable battery and a motion sensor, all of which are accommodated in the case of the electrically powered device, e.g. computer case. As shown in FIG. 5, certain electronic components are situated within component 36. Attached to component 36 is a hinge lever subminiature switch 37, which is part of the tamper switch, and sprung on-off trigger switch 38, which is part of the key switch.

Figure 6:
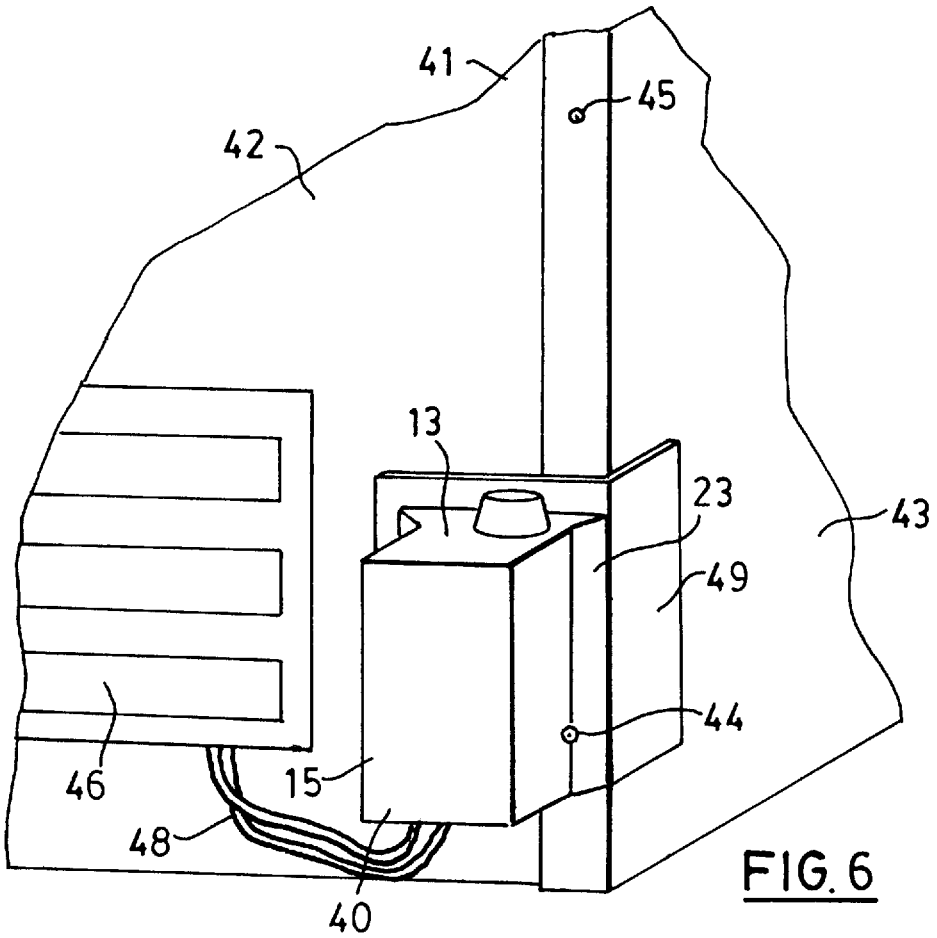
FIG. 6 is a view of an anti-theft alarm of the present invention installed on a computer case (partially shown).

With reference to FIG. 6, the box 40 is attached to computer case 41 which comprises a back 42 and cover 43. In the embodiment shown it is usual for the base 11 of box 40 to sit on an L-bracket 49. Cover 43 is attached to back 42 with screws 44, 45 and other screws not shown. Back 42 has a number of so-called expansion slots 46 therein. The electronic components in box 40 are connected by a cable 48 to the DC power supply, rechargeable battery, motion sensor and other components which are inside computer case 41.

In preparation for assembly, and in operation, plate 13, with attached lock 14, is situated in shroud 15, so that tongue 27 fits into slot 28 and plate 13 is firmly held in place with end posts 35. Just prior to assembly, plate 31 is in the position shown in FIG. 5 so that the alarm is unarmed, i.e. trigger switch 38 is open. Plate 13 is removable so that in the event that key 32 is lost, the whole of the lock assembly can be replaced quickly rather than having to wait for new keys to be cut. High security locks are preferable in order to minimize the risk that the lock can be picked and the alarm disarmed.

When installing the alarm, items inside the computer case are first installed. The connector cable 48 is led outside the computer case. L-bracket 49 is affixed to the computer cover 43, preferably with a strong adhesive. Base 11 is affixed to L-bracket 49, preferably with a strong adhesive. Cover 43 is then placed on the computer back 42 and the computer back affixed thereto, using mounting screws. One of the screws, 44, passes through one of the screw apertures 39 in base 11, thus assuring that the base, and therefore the computer cover 43, cannot easily be removed from the computer back without damaging the base 11. It should be noted that screw 44 will be inaccessible when shroud 15 is attached to base 11, and therefore screw 44 cannot be removed without first removing shroud 15.

The skirts 19 and 20 of shroud 15 are then slid inside walls 22 and 23 respectively of base 11, until end wall 18 touches wall 24. In practice, cable 48 is trapped between walls 18 and 24, and passes through cutout 29 in end wall 18. As shroud 15 is slid into place on base 11, a lever on hinge lever subminiature switch 37 touches post 26 on base 11 and is depressed, thus arming the tamper switch. Plate 31 of the lock is rotated with key 32 in the direction of arrow A in FIG. 5, so that tongue 33 depresses the spring on switch 38, thus arming the alarm. At the same time, tongue 34 moves behind stop 26 on base 11 so that the shroud 15 may not be removed from base 11 without first unlocking the lock 14 with key 32. The alarm is then armed.

Base 11 and the shroud 15 are stamped from metal sheet. However, they may be made of reasonably rigid synthetic plastic material.

In operation, in the event that someone attempts to cut cable 48 or apply brute force to lever box 40 off, the alarm will be immediately set off, and the only way to stop the alarm is to unlock the lock 14 with a key, and thus open switch 38. In the event that the AC power cable is unplugged and the computer moved without first unlocking lock 14, the motion sensor (not shown) will detect movement and trigger the alarm. As indicated hereinbefore, there may be a delay or the alarm may be at a low level for a few seconds in the event that the movement was unintentional. If no action is taken to unarm the alarm, the alarm will sound.

In order to insert new components in the computer, it is first necessary to disarm the alarm by unlocking the key switch. The shroud 15 is then removed from base 11 and screw 44 removed, together with other screws such as 45 which hold cover 43 in place. The cover 43 can then be removed, revealing the inside of the computer.

As is known, computers are often associated with peripherals such as printers, scanners, monitors, CD storage devices, tape and other storage devices, modems and the like, none of which generally have a convenient DC power source for use with the alarm of the present invention. Also in the typical office there is equipment such as fax machines, which also do not usually have convenient DC power sources. These peripherals and other devices can be protected by connecting them to an alarm of the present invention which is encased in the body of a computer. Each peripheral may be connected with wire which if cut or removed triggers the alarm immediately. Alternatively the peripheral device may detect separation from the computer and an alarm is triggered.

A single user of a computer would usually prefer to have the audible alarm built into the anti-theft device. Companies and institutions with large numbers of computers may prefer not to have an audible alarm at each individual computer, but would prefer to have the alarm condition show up in a central location, e.g security office. In such cases, instead of the audible alarm circuitry, the alarm condition may be transferred to the central location by telephone line or network.

In one embodiment of the invention the alarm design allows for electrical signals to be passed to other computer components and to accept electrical signals from other components. In this way alarm status may be communicated and arming, disarming and alarm functions may be triggered remotely.

An anti-theft device of the present invention was constructed using the circuit diagram of FIG. 2 and installed on a computer. All of the resistors were 0.25 watt, of the values shown in FIG. 2. All unmarked diodes were 1N4148. Integrated circuits IC1 an IC2 were CD4069 and transistors Q1 to Q4 were 2N4401. A second anti-theft device of the present invention was constructed using the diagram of FIG. 4. The alarms so-constructed operated and activated substantially as described above.

I claim:

1. An anti-theft alarm for an externally powered electrically operated device, said device having a case and an openable cover, said case and cover containing internal components, said alarm comprising:

(a) a rechargeable battery;

(b) a motion sensor to detect movement of the device;

(c) a key switch which in a first position is able to disarm the alarm when the DC power is off and in a second position is able to arm the alarm;

(d) a housing which contains at least a tamper switch and the key switch, which housing has a base and a shroud selected from the group consisting of i) said base being attachable to the case for the electrically operated device, said key switch being attached to the shroud, and said key switch and base having means such that when the key switch is locked, the shroud cannot be removed from the base and, when the key switch is unlocked, the shroud is detachable from the base and ii) said base being attachable to the case for the electrically operated device, said key switch being attached to the base, and said key switch and base having means such that, when the key switch is locked, the shroud cannot be removed from the base and, when the key switch is unlocked the shroud is detachable from the base; said base being attached to the device by securing means which also secures the openable cover to the case, wherein at least part of the securing means is accessible only from inside the housing to release the openable cover from the case:

e) a DC power supply for providing said DC power, and being connected to a circuit for recharging the battery, said DC power supply being dependent on an external power supply for the device, f) controller means, for activating a warning means, powered by the battery, said controller means being activated by a condition selected from the group consisting of i) no DC power and activation of the motion sensor and ii) activation of the tamper switch;

g) an arming latch which keeps the warning means activated when either of the conditions in f) is satisfied.

2. The anti-theft alarm according to claim 1 wherein the tamper switch comprises a cooperating post and hinge lever switch.

3. The anti-theft alarm according to claim 1 which has the warning means connected to the controller means, in which the warning means is in a location selected from inside the electrically operated device and inside the housing.

4. The anti-theft alarm according to claim 1 which has the warning means connected to the controller means, in which the warning means is external to the electrically operated device and the housing.

5. The anti-theft alarm according to claim 3 wherein the tamper switch comprises a cooperating post and hinge lever switch.

6. The anti-theft alarm according to claim 3 wherein the housing is attached to the electrically operated device and the means for securing the openable cover to the case is at least one screw, said screws being accessible for removal only after removal of the shroud.

7. The anti-theft alarm according to claim 3 wherein the shroud has a replaceable plate, said plate having the key switch attached thereto, said replaceable plate being replaceable only after the shroud has been removed from the base.

8. The anti-theft alarm according to claim 6 wherein the shroud has a replaceable plate, said plate having the key switch attached thereto, said replaceable plate being replaceable only after the shroud has been removed from the base.

* * * * *